US012716160B2

(12) United States Patent
Becchio et al.

(10) Patent No.: US 12,716,160 B2
(45) **Date of Patent: *Aug. 25, 2026**

(54) WASHING MACHINE PROVIDED WITH A MICROPLASTIC FILTERING SYSTEM INTEGRATED WITH THE DRAWER

(71) Applicant: ELBI INTERNATIONAL S.P.A, Turin (IT)

(72) Inventors: Marco Becchio, Carignano (IT); Gianluca Benedetto, Turin (IT); Luca Garetto, Turin (IT); Luca Maiorana, Turin (IT)

(73) Assignee: ELBI INTERNATIONAL S.P.A, Turin (IT)

( * ) Notice: Subject to any disclaimer, the term of this patent is extended or adjusted under 35 U.S.C. 154(b) by 175 days.

This patent is subject to a terminal disclaimer.

(21) Appl. No.: 18/824,513

(22) Filed: Sep. 4, 2024

(65) Prior Publication Data

US 2025/0075403 A1 Mar. 6, 2025

(30) Foreign Application Priority Data

Sep. 4, 2023 (IT) ..... 102023000018126

(51) Int. Cl.
*D06F 39/08* (2006.01)
*D06F 39/10* (2006.01)
*D06F 39/14* (2006.01)

(52) U.S. Cl.
CPC ..... *D06F 39/085* (2013.01); *D06F 39/10* (2013.01); *D06F 39/14* (2013.01)

(58) Field of Classification Search
None
See application file for complete search history.

(56) References Cited

U.S. PATENT DOCUMENTS

| | | | | |
|---|---|---|---|---|
| 2023/0030772 | A1 | 2/2023 | Root et al. | |
| 2023/0151523 | A1 | 5/2023 | Roetker et al. | |
| 2024/0150953 | A1* | 5/2024 | Milz | A47L 15/0049 |

FOREIGN PATENT DOCUMENTS

| | | | |
|---|---|---|---|
| EP | 4148178 | A1 | 3/2023 |
| WO | 2019/081013 | A1 | 5/2019 |
| WO | 2022/104167 | A1 | 5/2022 |

OTHER PUBLICATIONS

Search Report for Italian Patent Application No. 102023000018126 (Feb. 13, 2024).

* cited by examiner

*Primary Examiner* — Rita P Adhlakha
(74) *Attorney, Agent, or Firm* — Merchant & Gould P.C.

(57) ABSTRACT

A washing machine includes a cabinet in which a washing tub is defined. A discharge piping fluidically connects to the washing tub on one side, and connectable to a waste system on the other side. A discharge pump is situated in the discharge piping and is configured to push a washing liquid, containing microplastics and coming from the washing tub, towards the waste system. A discharge pump filter is situated in the discharge piping fluidically upstream of the discharge pump and is configured to trap any foreign bodies that may be present in the microplastic-containing washing liquid. A microplastic filtering system is situated in the discharge piping fluidically downstream of the discharge pump. A drawer internally houses the system.

14 Claims, 9 Drawing Sheets

WASHING MACHINE PROVIDED WITH A MICROPLASTIC FILTERING SYSTEM INTEGRATED WITH THE DRAWER

This application claims benefit of Italian Patent Application No. 102023000018126, filed Sep. 4, 2023, which application is incorporated herein by reference. To the extent appropriate, a claim of priority is made to the above-disclosed application.

TECHNICAL FIELD

The present invention relates to a washing machine comprising a microplastic filtering system.

TECHNICAL BACKGROUND

Washing machines provided with microplastic filtering systems are known in the art.

In recent years, the use of synthetic fabrics has increased, resulting in larger amounts of micrometric synthetic microfibres contained in wastewater and hence in the environment, leading to more environmental pollution. In particular, when synthetic fabrics are washed, synthetic microfibres are produced/released which are not biodegradable, thus causing increased water pollution from microplastics (this term refers to particles and/or fibres less than 5 mm in length).

Patent publication EP 4 148 178 A1 by the present Applicant describes a microplastic filtering system specifically intended for use in a laundry washing machine. The system can filter microplastics contained in the washing liquid, which is then drained from the washing tub. Although such system is particularly advantageous and effective in comparison with those previously known in the art, it is nonetheless desirable to add thereto some improvements and refinements.

One drawback of the system disclosed by patent publication EP 4 148 178 A1 lies in the fact that it does not propose a mode of installation of such system in the washing machine that will allow a user to easily gain access to such system, e.g. for inspecting and/or replacing components thereof.

SUMMARY OF THE INVENTION

It is one object of the present invention to provide a washing machine which is provided with a microplastic filtering system, and which can remedy one or more drawbacks of the prior art.

In particular, compared with the prior art, the washing machine made in accordance with the present invention solves the technical problem of allowing a user to easily gain access to the microplastic filtering system in order to inspect and/or replace the components thereof.

According to the present invention, this and other objects are achieved through a washing machine having the technical features set out in the appended independent claim. In particular, the fact that the microplastic filtering system is housed inside the drawer makes for easier access by the user.

It is understood that the appended claims are an integral part of the technical teachings provided in the following detailed description of the present invention. In particular, the appended dependent claims define some preferred embodiments of the present invention that include some optional technical features.

Further features and advantages of the present invention will become apparent in light of the following detailed description, provided herein merely as a non-limiting example and referring, in particular, to the annexed drawings as summarized below.

Figure 1:
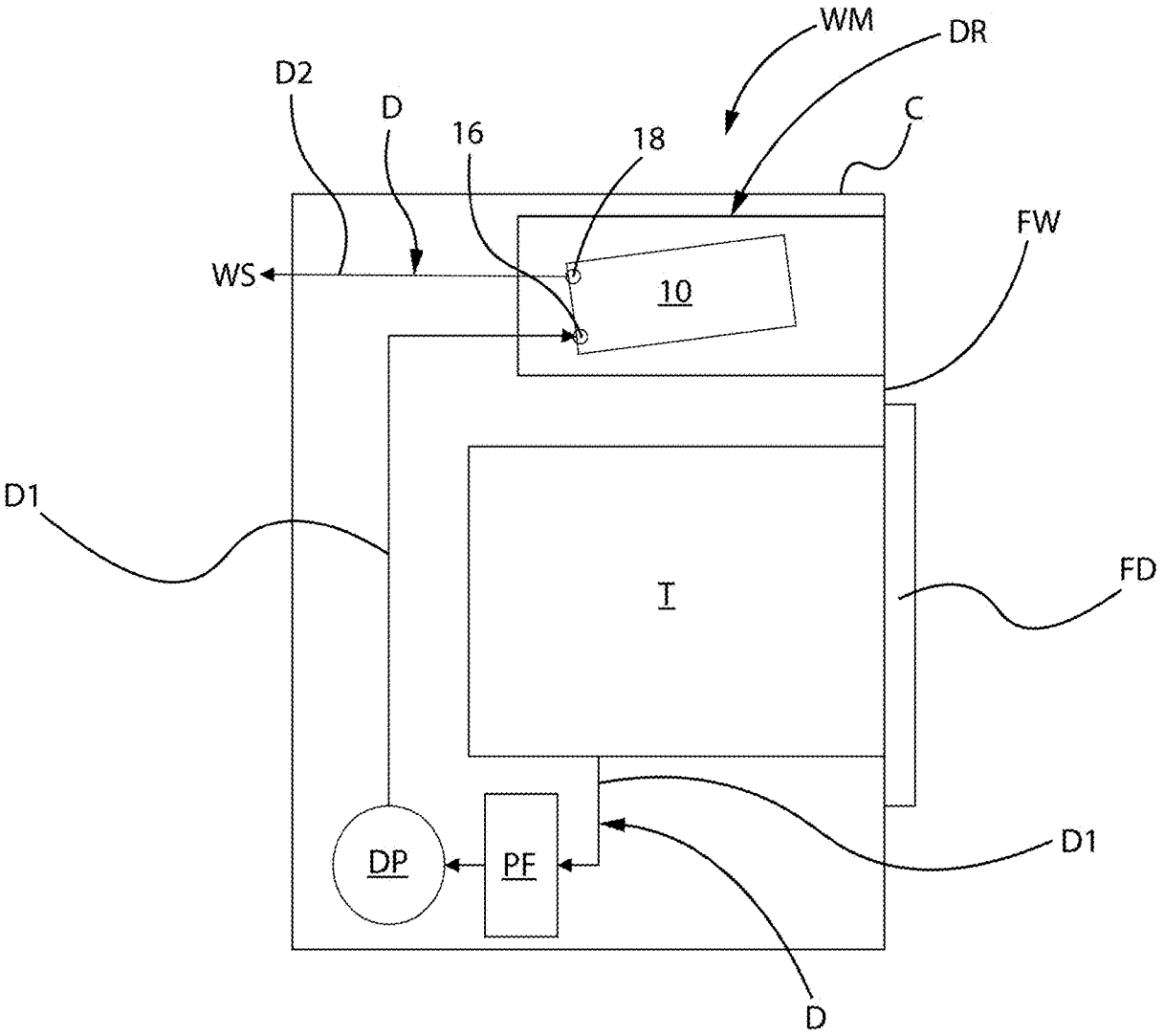
FIG. 1 is a schematic view representing a washing machine, such as a laundry washing machine, provided with a microplastic filtering system and made in accordance with an illustrative embodiment of the present invention.

For completeness' sake, the following is a list of alphanumerical references and names used herein to identify parts, elements and components illustrated in the above-summarized drawings.

WM. Laundry washing machine
C. Cabinet
T. Washing Tub
D. Discharge piping
D1. Initial duct
D2. Terminal duct
WS. Waste system
DP. Discharge pump
PF. Discharge pump filter
FW. Front wall
IF. Inner face
TD. Top door
DR. Drawer
DH. Drawer holder
H. Housing
DW. Divider wall
CV. Cover
BH. Bottom opening
RO. Return openings
SB. Support bracket
X-X. Longitudinal axis
10. Filtering system
12. Casing
14. Cavity
14*a*. Central chamber
14*b*. Peripheral chamber
14*c*. Storing chamber
16. Inlet
18. Outlet
20. Storing container

22. Tubular portion
24. Cover member
26. Closure member
30. Sealing gaskets
100. Filtering assembly
102. Hollow filtering body
104. Axial through aperture
200. Compacting assembly
202. Endless screw
204. Helicoidal profile
300. Driving assembly
302. Electric motor
303. Reduction gear train
304. Driven member

DETAILED DESCRIPTION OF THE INVENTION

With reference to FIGS. 1 to 5, there is shown a washing machine provided with a microplastic filtering system 10 made in accordance with an illustrative embodiment of the present invention. In the illustrated embodiment, the washing machine is a laundry washing machine, designated as a whole as WM; however, in further variant embodiments the washing machine may be different from laundry washing machine WM, e.g. it may be a dishwashing machine. Moreover, the term "microplastics" refers to particles and/or fibres of synthetic or plastic material which are less than 5 mm in length, and which, in particular, may also have micrometric dimensions.

With particular reference to FIG. 1, laundry washing machine WM comprises a cabinet C in which a washing tub T is defined, which is sealed from the outside environment by a front door FD hinged to a front wall FW of cabinet C. Laundry washing machine WM comprises also, in a per se known manner, a basket (not shown) rotatably mounted in washing tub T.

Laundry washing machine WM comprises a discharge piping, designated as a whole as D. Discharge piping D is fluidically connected to washing tub T on one side and connectable to the waste system WS on the other side.

In addition, washing machine WM comprises a discharge pump DP situated in discharge piping D and configured to push the washing liquid, containing microplastics and coming from washing tub T, towards waste system WS.

Furthermore, washing machine WM comprises a discharge pump filter PF situated in discharge piping D fluidically upstream of discharge pump DP and configured to trap any foreign bodies that may be present in the microplastic-containing washing liquid. Typically, foreign bodies are much bigger than microplastic particles, and may damage discharge pump DP.

As mentioned above, washing machine WM comprises also a system 10, which is situated in discharge piping D fluidically downstream of discharge pump DP and is configured to internally trap the microplastics contained in the washing liquid.

Washing machine WM comprises also a drawer DR in which system 10 is housed. This makes it easier for the user to gain access to system 10.

In the illustrated embodiment, drawer DR is mounted movable relative to cabinet C. However, in further variant embodiments (not shown), the drawer may be mounted stationary relative to the cabinet of the washing machine. More generally, drawer DR essentially forms a housing (which may be, as aforementioned, either fixed or movable)—or, even more generally, a support—in which system 10 is housed.

Advantageously, but not necessarily, drawer DR defines a receptacle R configured to house a quantity of a washing agent intended to be delivered into washing tub T. By way of example, in the illustrated embodiment such quantity of washing agent can be loaded into receptacle R by a user; as an alternative, receptacle R can be loaded with such quantity of washing agent by a so-called "autodosing" system. In particular, if drawer DR is provided with one or more of such receptacles R, there is a further advantage that it is accessible by simply operating the same drawer DR which is used for loading the washing agent.

In the illustrated embodiment, receptacle R is open at the top and perimetrically delimited by sidewalls of drawer DR. In the illustrated embodiment, drawer DR has just one receptacle R, but in further variant embodiments the drawer may include more than one receptacle R to receive more than one washing agent.

Preferably, drawer DR is mounted extractable from a front wall FW of cabinet C. In particular, drawer DR is located above washing tub T. In the illustrated embodiment, washing machine WM is of the so-called "front-load" type, wherein the basket is loaded through front door FD, which is mounted to front wall FW of cabinet C.

In particular, discharge piping D comprises an initial duct D1 fluidically connected to washing tub T on one side and to an inlet 16 of system 10 on the other side; in addition, discharge piping D comprises a terminal duct D2, in turn fluidically connected to an outlet 18 of system 10 on one side and fluidically connectable to waste system WS on the other side. Therefore, the "dirty" washing liquid, which contains microplastics, coming from washing tub T flows in initial duct D1, while the "filtered" washing liquid, substantially free from such microplastics, flows in terminal duct D2. In particular, discharge pump filter PF is situated in initial duct D1 and is fluidically connected downstream of washing tub T. Discharge pump filter PF is configured for filtering any foreign bodies from the microplastic-containing washing liquid coming from washing tub T before the washing liquid enters discharge pump DP. Typically, the outlet of discharge pump filter PF is hydraulically connected to the inlet of discharge pump DP. Therefore, discharge pump filter FP and discharge pump FP are fluidically connected in series in initial duct D1, upstream of inlet 16 of system 10.

In the illustrated embodiment, cabinet C comprises a drawer holder DH in which said drawer DR is slidably, in particular translatably, mounted. In more detail, drawer DR is configured to translate in a direction substantially perpendicular to the plane defined by front wall FW of washing machine WM.

In the illustrated embodiment, drawer DR defines a housing H in which system 10 is inserted. Housing H is perimetrically defined by sidewalls of drawer DR and borders on receptacle R. In particular, drawer DR comprises a divider wall DW that laterally separates receptacle R from housing H.

In addition, drawer DR comprises a cover CV, which is mounted over housing H and, as will be described in more detail below, covers at least a portion of system 10.

As will be further described below also with reference to FIGS. 2 to 5, system 10 comprises a casing 12 internally defining a cavity 14. Casing 12 has a substantially tubular shape and develops along a longitudinal axis X-X.

In the embodiment described in the following, as concerns the elements and components of system 10, terms or expressions such as "axial" or "axially", "transversal" or "transversally", "radial" or "radially", "lateral" or "laterally", "internal" or "internally", "external" or "externally", "annular" or "annularly", "peripheral" or "peripherally" are meant with reference to longitudinal axis X-X.

As aforementioned, inlet 16 is configured to receive a microplastic-containing fluid and leads into cavity 14. Further, outlet 18 is configured to deliver the fluid contained in cavity 14, from which the microplastics have been substantially removed.

System 10 further comprises a filtering assembly 100 contained in cavity 14. Filtering assembly 100 is configured to be crossed by the fluid (i.e. the above-defined washing liquid) entering casing 12 through inlet 16 and exiting through outlet 18, thus internally trapping the microplastics contained in said fluid. In particular, filtering assembly 100 is, in a per se known manner, configured for trapping particles and/or fibres of synthetic or plastic material less than 5 mm in length, which may also, in particular, have micrometric dimensions.

In the illustrated embodiment, casing 12 comprises a tubular portion 22 and a closure member 26 sealingly connected on opposite sides to tubular portion 22. Tubular portion 22 and closure member 26 internally define cavity 14. In particular, cavity 14 is laterally delimited by tubular portion 22 and axially delimited, on opposite sides, by tubular portion 22 and by closure member 26. In addition, tubular portion 22 develops around longitudinal axis X-X. Preferably, cover CV covers tubular portion 22, leaving closure member 26 uncovered and accessible, particularly when drawer DR is brought into an extracted position (or a raised position, in the embodiment illustrated in FIGS. 6 to 9) relative to cabinet C.

As will be described in more detail below, inlet 16 and outlet 18 lead into cavity 14 through casing 12 in a substantially transversal direction (i.e. a direction substantially perpendicular to longitudinal axis X-X).

In the illustrated embodiment, inlet 16 essentially consists of an L-shaped fitting, which is connected in the axial direction, at one end thereof, to initial duct D1 and connected in the transversal or radial direction, at the other end thereof, to casing 12. Outlet 18 consists of a fitting that protrudes laterally from casing 12, i.e. with an axis oriented transversally to longitudinal axis X-X. In more detail, inlet 16 and outlet 18 are formed on the tubular portion 22.

Preferably, filtering assembly 100 comprises a hollow filtering body 102 having an axial through aperture 104. Hollow filtering body 102 comprises, advantageously, a plurality of concentrical cylindrical filtering layers of different mesh gauges suitable for trapping microplastic particles of different sizes. In the embodiment illustrated herein, filtering assembly 100 is removable from casing 12.

System 10 comprises also a compacting assembly 200 situated in cavity 14 and configured for collecting and compacting the microparticles trapped by filtering assembly 100.

In addition, washing machine WM comprises a driving assembly 300 configured to drive compacting assembly 200. Preferably, driving assembly 300 comprises a motor, in particular an electric motor 302. In the illustrated embodiment, electric motor 302 co-operates with a reduction gear train 303 to drive compacting assembly 200. In particular, driving assembly 300 is housed in cover member 24.

Preferably, as will be described hereafter, compacting assembly 200 extends axially through filtering assembly 100. In particular, axial through aperture 104 of hollow filtering body 102 is crossed by compacting assembly 200.

In the illustrated embodiment, compacting assembly 200 is configured to remove microplastics from the inner surface of hollow filtering body 102, in particular conveying them out of filtering assembly 100. In other words, compacting assembly 200 is operatively mounted in contact with the inner lateral surface of hollow filtering body 102, defined by axial through aperture 104, for removing microplastics from the filtering assembly. In this manner, compacting assembly 200 is configured to operatively slide against said inner lateral surface of hollow filtering body 102, thereby removing microplastics from such surface.

In the illustrated embodiment, compacting assembly 200 comprises an endless screw 202 configured to be rotatably driven by driving assembly 300, so as to axially push the solid particles trapped by filtering assembly 100.

In addition, endless screw 202 is housed in axial through aperture 104 of hollow body 102, and is substantially aligned axially with longitudinal axis X-X.

In particular, endless screw 202 has a helicoidal profile 204 that, in a per se known manner, facilitates the conveyance of microplastics out of filtering assembly 100. In other words, helicoidal profile 204 is operatively mounted in contact with the inner lateral surface of hollow filtering body 102. In this way, helicoidal profile 204—rotatably driven by driving assembly 300—can effectively remove the microplastics deposited on said surface of hollow filtering body 102. In fact, helicoidal profile 204 is configured to rotatably slide against said surface of hollow filtering body 100, thereby removing microplastics therefrom.

Figure 2:
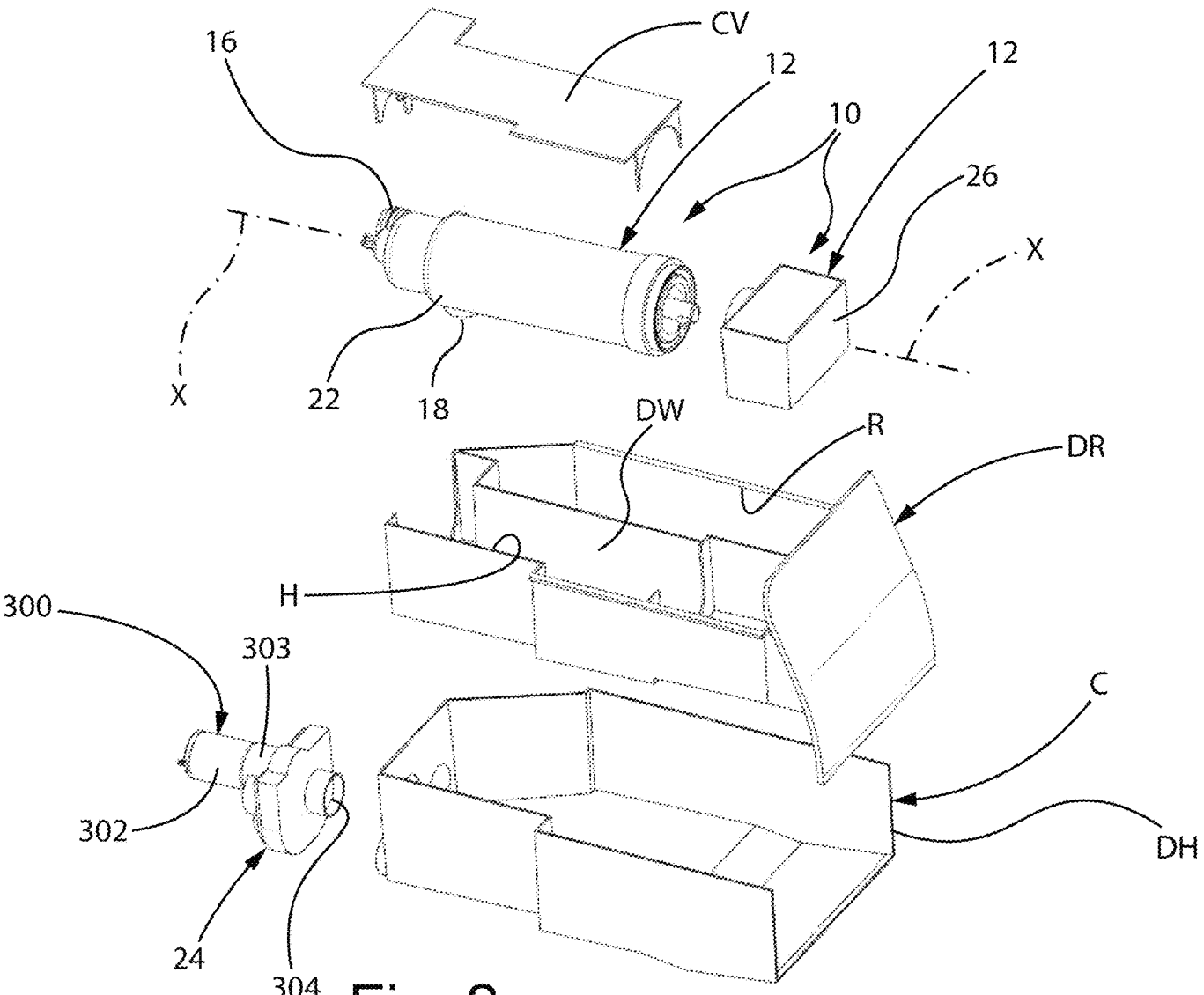
FIG. 2 is an exploded perspective view of a drawer of the washing machine shown in FIG. 1. The drawer contains the microplastic filtering system, and is mounted slidable in a drawer holder defined by the cabinet of the washing machine.
Figure 3:
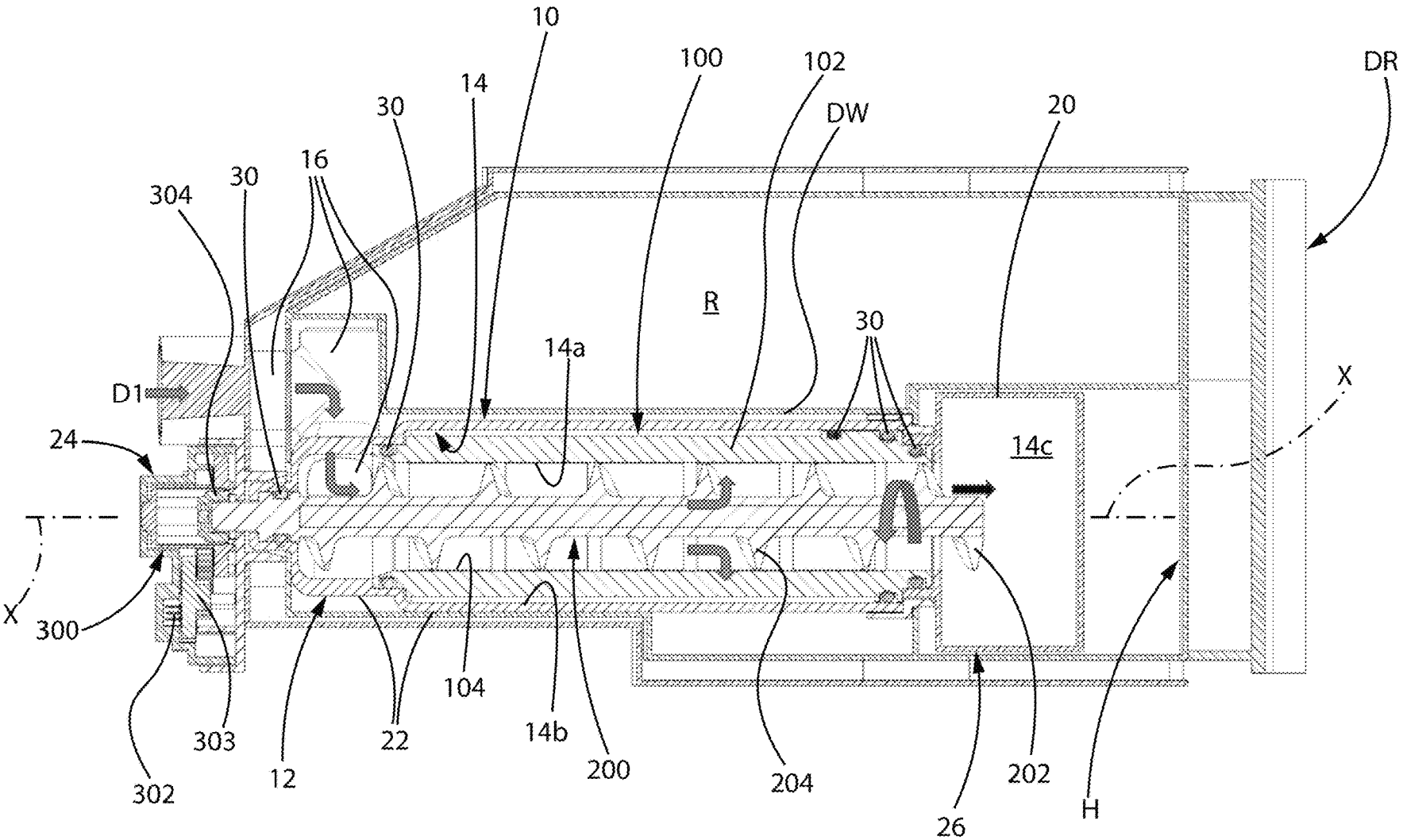
FIG. 3 is a sectional top view of the drawer and drawer holder shown in FIG. 2, showing the flow of washing liquid entering the microplastic filtering system.
Figure 4:
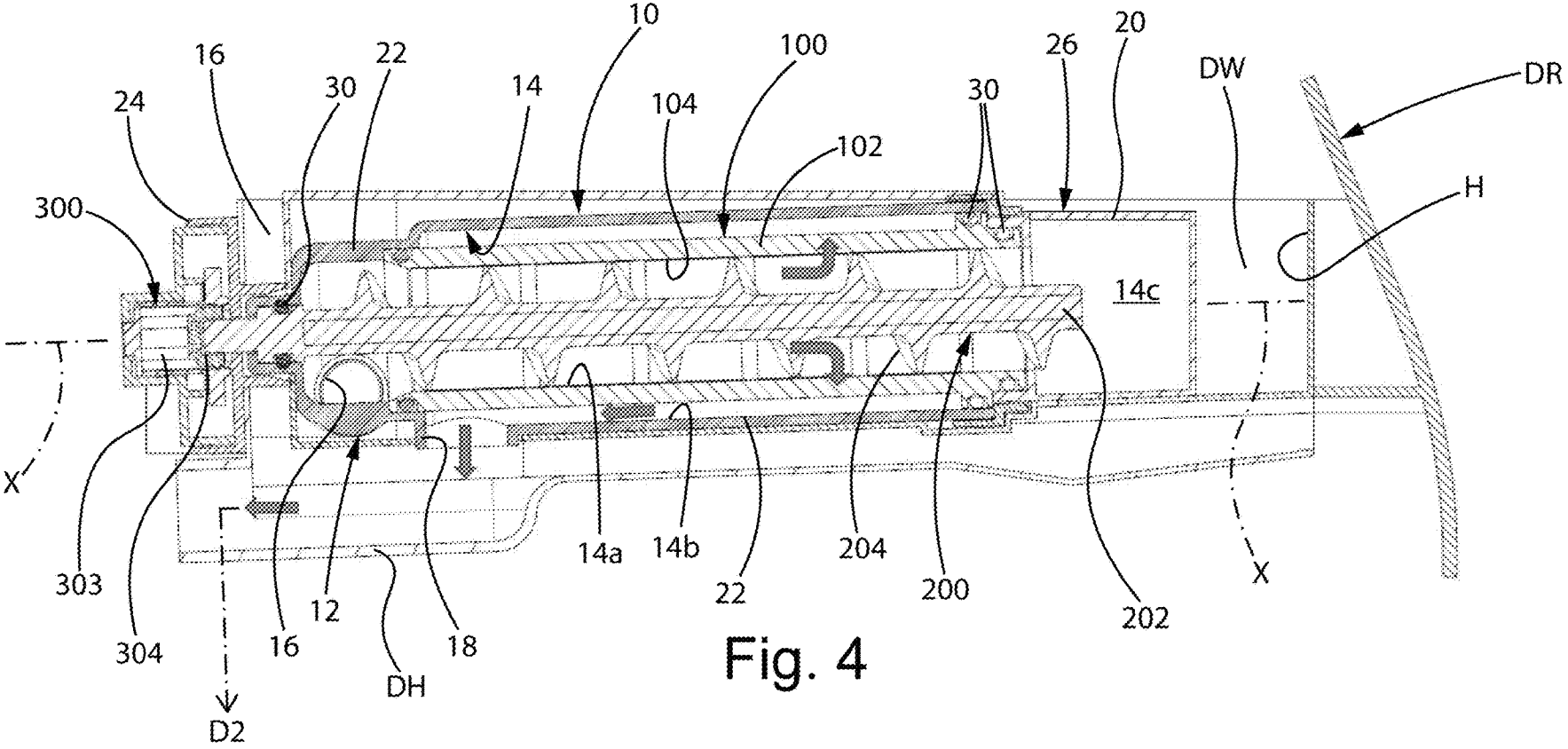
FIG. 4 is a sectional view in side elevation of a part of FIG. 3, showing the flow of washing liquid exiting the microplastic filtering system.

As clearly visible in FIG. 2, cavity 14 is divided into a plurality of chambers 14*a*, 14*b*, 14*c*, in particular by inner walls of casing 12 and/or outer walls of filtering assembly 100. First of all there is a central chamber 14*a*, laterally and axially delimited within filtering assembly 100, into which inlet 16 directly leads; central chamber 14*a* is axially crossed by compacting assembly 200 (in particular, by endless screw 202). In particular, central chamber 14*a* is also delimited laterally within hollow filtering body 102 and axially by an axial end of tubular portion 22. There is also a peripheral chamber 14*b* situated around central chamber 14*a* and bordering thereon via the walls of hollow filtering body 102, while it is delimited axially by inner walls of tubular portion 22; outlet 18 extends transversally from peripheral chamber 14*b*. Lastly, there is a storing chamber 14*c* facing towards compacting assembly 12 (in particular, facing towards a free end of endless screw 202). In addition, storing chamber 14*c* is adjacent, in the axial direction, to central chamber 14*a* and in direct fluidic communication with such central chamber 14*a*; said storing chamber 14*c* is laterally and axially delimited by casing 12, in particular by closure member 26.

In particular, closure member 26 comprises a storing container 20 facing towards compacting assembly 200. Storing container 20 is configured for receiving the microplastics collected and compacted by compacting assembly 200. In particular, storing container 20 is made as one piece with closure member 26. Preferably, the assembly including closure member 26 and storing container 20 is mounted integrally removable from tubular body 22. In some alternative variant embodiments, the storing container may be separable from the closure member, e.g. being housed therein.

Storing container 20, which in the illustrated embodiment is made as one piece with closure member 26, internally defines storing chamber 14*c*. In particular, closure member 26 and storing container 20, which is defined by the former, create as a whole a substantially cup-shape profile. In addition, axial through aperture 104 of hollow body 102 faces towards storing container 20. As aforementioned, closure member 26 is mounted to tubular portion 22 and removable, in particular repeatably and reversibly, therefrom. For example, as visible in FIGS. 2 and 5, closure member 26 can be coupled to and, respectively, removed from tubular portion 22, so that a user can gain access to the inside of casing 12. Particularly, a bayonet mechanism or a threaded connection may be provided for removably coupling closure member 26 to tubular portion 22. Therefore, by removing closure member 26 from tubular portion 22 it is possible to remove and/or replace storing container 20 (whether made as one piece with closure member 26 or housed inside the latter) from casing 12 in order to empty it of the microplastics accumulated therein and compacted by compacting assembly 200.

In the system arrangement shown in FIG. 1, longitudinal axis X-X is oriented in a substantially horizontal direction, with such an inclination, when washing machine WM is in operation, that storing chamber 12*c* and storing container 20 are in a higher position than filtering assembly 100 and compacting assembly 200. This facilitates the outflow of the washing liquid from central chamber 14*a* towards peripheral chamber 14*b*.

Driving assembly 300, which is preferably housed in cover member 24, comprises a driven member 304 configured to be rotatably driven by electric motor 302, in particular through reduction gear train 303, so as to drive compacting assembly 200.

In particular, driven member 304 is an element configured to be engaged with compacting assembly 200. In the embodiment illustrated herein, driven member 304 can be coupled to endless screw 202 to control the rotation thereof, such elements being, in particular, mutually integral in rotation (e.g. keyed to each other). In more detail, when mutually coupled, driven member 304 and endless screw 202 are substantially coaxial to each other and to longitudinal axis X-X. In particular, endless screw 202 is sealingly supported in rotation by casing 12, in particular at an axial end of tubular portion 22.

In particular, cover member 24 and the associated driving assembly 300 are mounted on a stationary support structure of cabinet C, which in the embodiment illustrated herein is drawer holder DH. In other words, they form an assembly that is fluidically separate and mechanically separable and removable from casing 12 (and hence from system 10), in particular from tubular portion 22 and closure member 26, which are housed in drawer DR. For example, cover member 24 and the associated driving assembly 300 are mounted to the outside of a back wall of drawer holder DH, while compacting assembly 200 is configured to face towards and be engaged with driving assembly 300 through a back wall of drawer DR. Thus, when drawer DR is moved into a retracted position in drawer holder DH (FIGS. 3 and 4), the extremity of endless screw 202 is engaged into driven member 304; conversely, when drawer DR is moved into a position where it is extracted from drawer holder DH (not shown), the extremity of endless screw 202 is disengaged and unconstrained from driven member 304. Therefore, the retracted position corresponds to an engagement position, in which driving assembly 300 is enabled to mechanically co-operate with compacting assembly 200, whereas the extracted position corresponds to a disengagement position, in which driving assembly 300 is not enabled to mechanically co-operate with compacting assembly 200.

By way of example, fluid-tightness of casing 12 is obtained by means of a plurality of sealing gaskets 30 interposed between closure member 26 and tubular portion 22. In particular, sealing gaskets 30 have a substantially annular shape, e.g. they are O-rings.

For completeness' sake, the following will briefly describe the path followed by the washing liquid in system 10, from washing tub T to waste system WS.

Inlet 16, which is hydraulically connected to initial duct D1 of discharge piping D, is configured to receive, substantially in a transversal or radial direction, the microplastic-containing washing liquid delivered by pump DP. Subsequently, inlet 16 runs through tubular portion 22 of casing 12 and into central chamber 14*a* defined in filtering assembly 100 by hollow filtering body 102.

Central chamber 14*a* receives the microplastic-containing washing liquid and hydraulically communicates, transversally or radially, with peripheral chamber 14*b* through the sidewalls of hollow filtering body 102. In particular, in the substantially horizontal arrangement of system 10 shown in FIG. 2, the washing liquid flows from central chamber 14*a* to peripheral chamber 14*b* also by gravity, since peripheral chamber 14*b* is underneath. Therefore, central chamber 14*a* retains the microplastics within hollow filtering body 102, so that peripheral chamber 14*b* receives washing liquid which is substantially free from microplastics.

At the same time, central chamber 14*a* hydraulically communicates, in the axial direction, with storing chamber 14*c*, which, due to the action of compacting assembly 200, receives the microplastics retained within the hollow filtering body, and traps them in the storing container 20.

Figure 5:
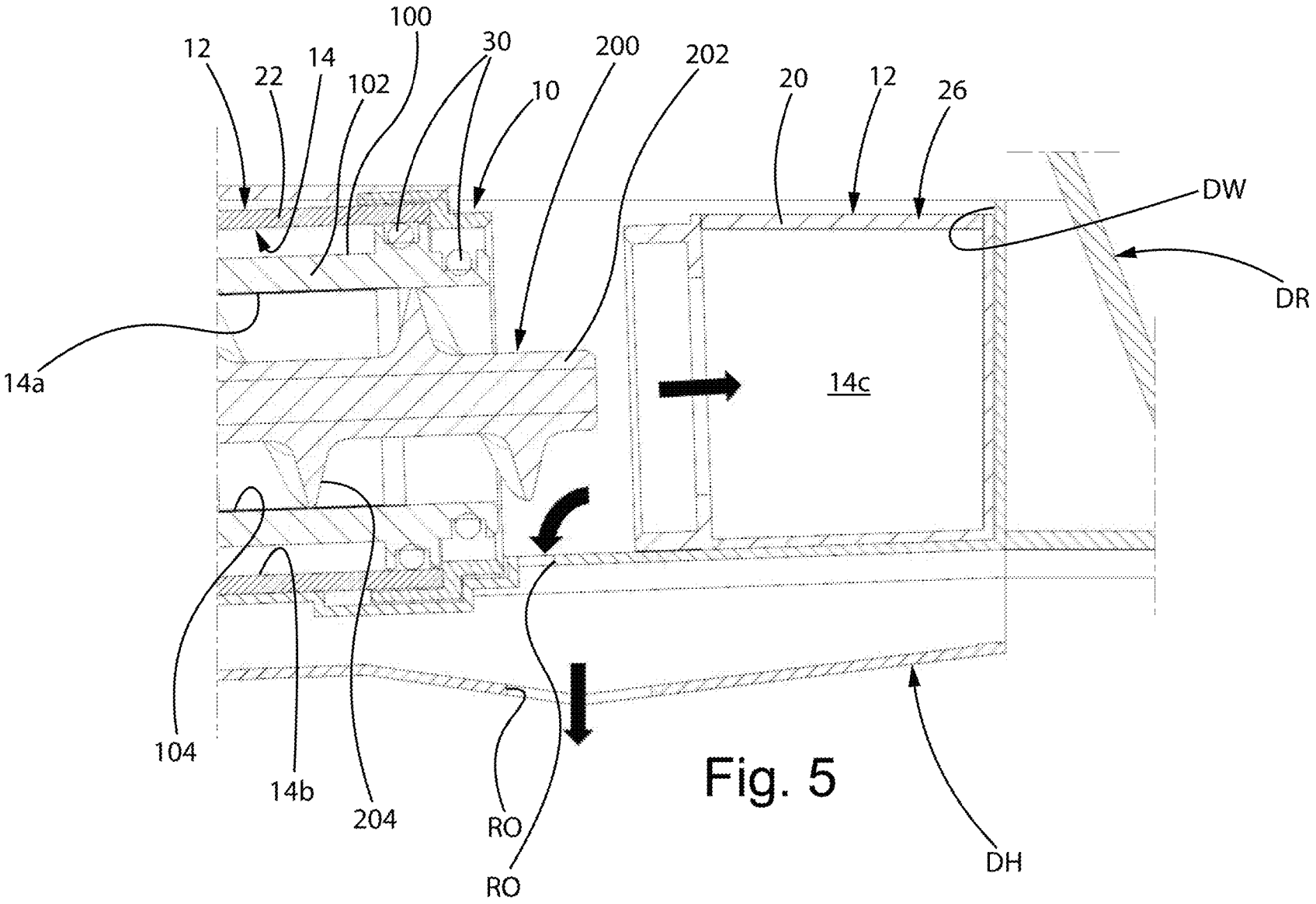
FIG. 5 is a magnified view similar to FIG. 4, showing a storing container removed from the microplastic filtering system.

Subsequently, the washing liquid, from which microplastics have been substantially removed, flows out of peripheral chamber 14*b*, transversally or radially, through outlet 18 to exit tubular portion 22 of casing 12. Outlet 18 is fluidically connected to terminal duct D2 of discharge piping D2, thus delivering to waste system WS washing liquid which is substantially free from microplastics. In the illustrated embodiment, outlet 18 runs through a bottom opening BH formed in drawer DR, so as to fluidically connect to terminal duct D2 through the back wall and/or the bottom of drawer holder DH. As shown in FIG. 5, drawer DR and drawer holder DH may have return openings RO mutually aligned in a descending direction and leading into washing tub T. Return openings RO are located, in particular, between tubular portion 12 and cover member 26 comprising storing container 20. In this manner, any liquid leaking or dripping during the operation of system 10 and/or during the removal of closure member 26 will be directed into washing tub T.

With reference to FIGS. 6 to 9, there is shown a washing machine WM made in accordance with a further embodiment of the present invention.

Those parts and elements which are similar to—or which perform the same function as—those of the previously illustrated embodiment have been assigned the same reference numerals. For brevity, the description of such parts and elements will not be repeated below, and reference should be made to the description of the previous embodiment.

The washing machine illustrated in FIGS. 6 to 9 is of the so-called "top-loader" type, wherein the basket is loaded through a top door TD mounted on top of cabinet C.

In the illustrated embodiment, drawer DR is mounted on an inner face IF of top door TD hinged to cabinet C. In particular, drawer DR is situated above washing tub T. Therefore, unlike the previously described embodiment, drawer DR is not mounted slidable in a drawer holder.

Figure 6:
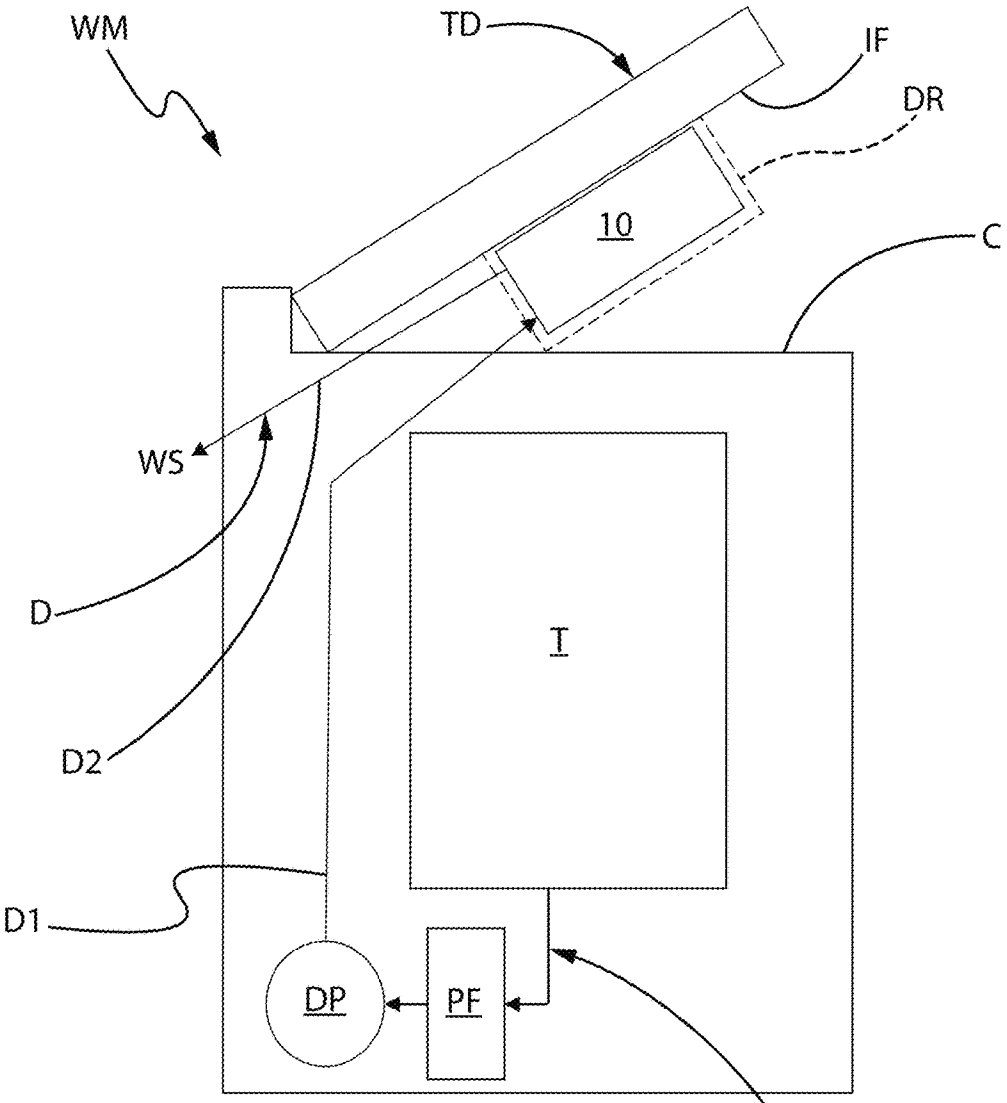
FIG. 6 is a schematic view representing a washing machine, such as a laundry washing machine, provided with a microplastic filtering system and made in accordance with a further illustrative embodiment of the present invention.
Figure 7:
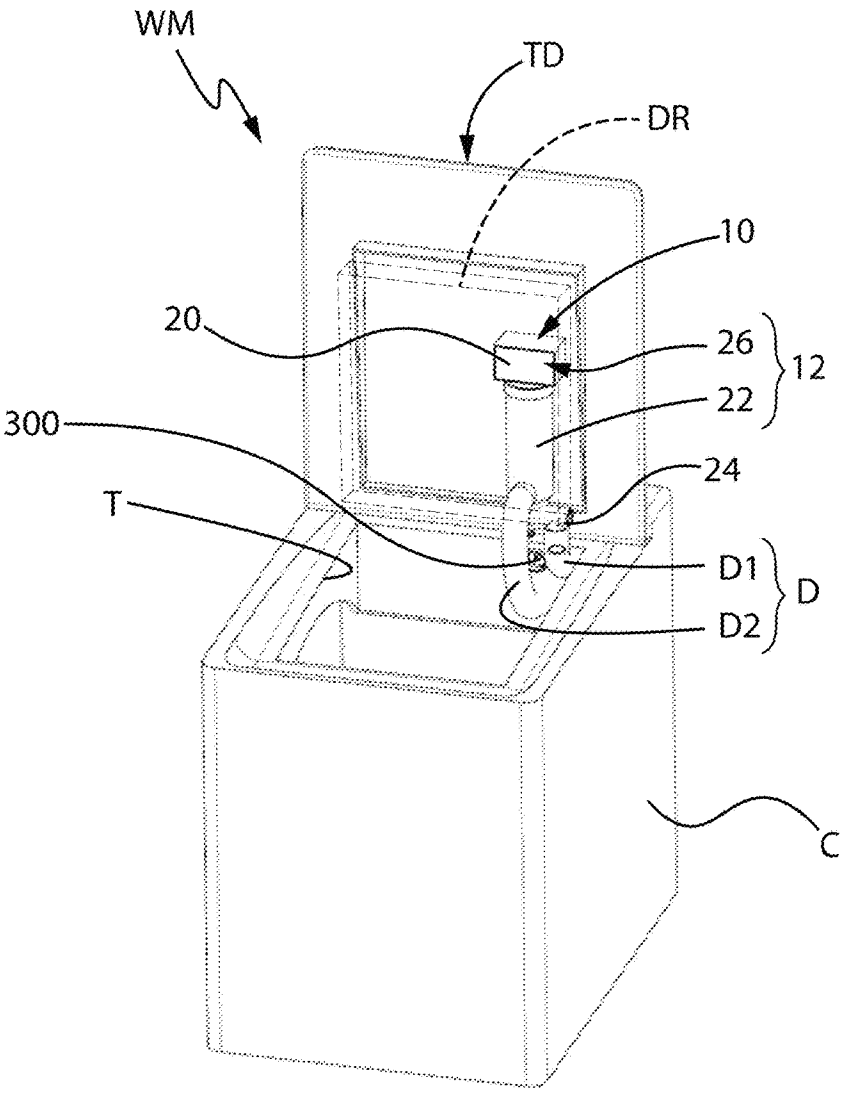
FIG. 7 is a perspective view of the washing machine shown in FIG. 6.
Figure 8:
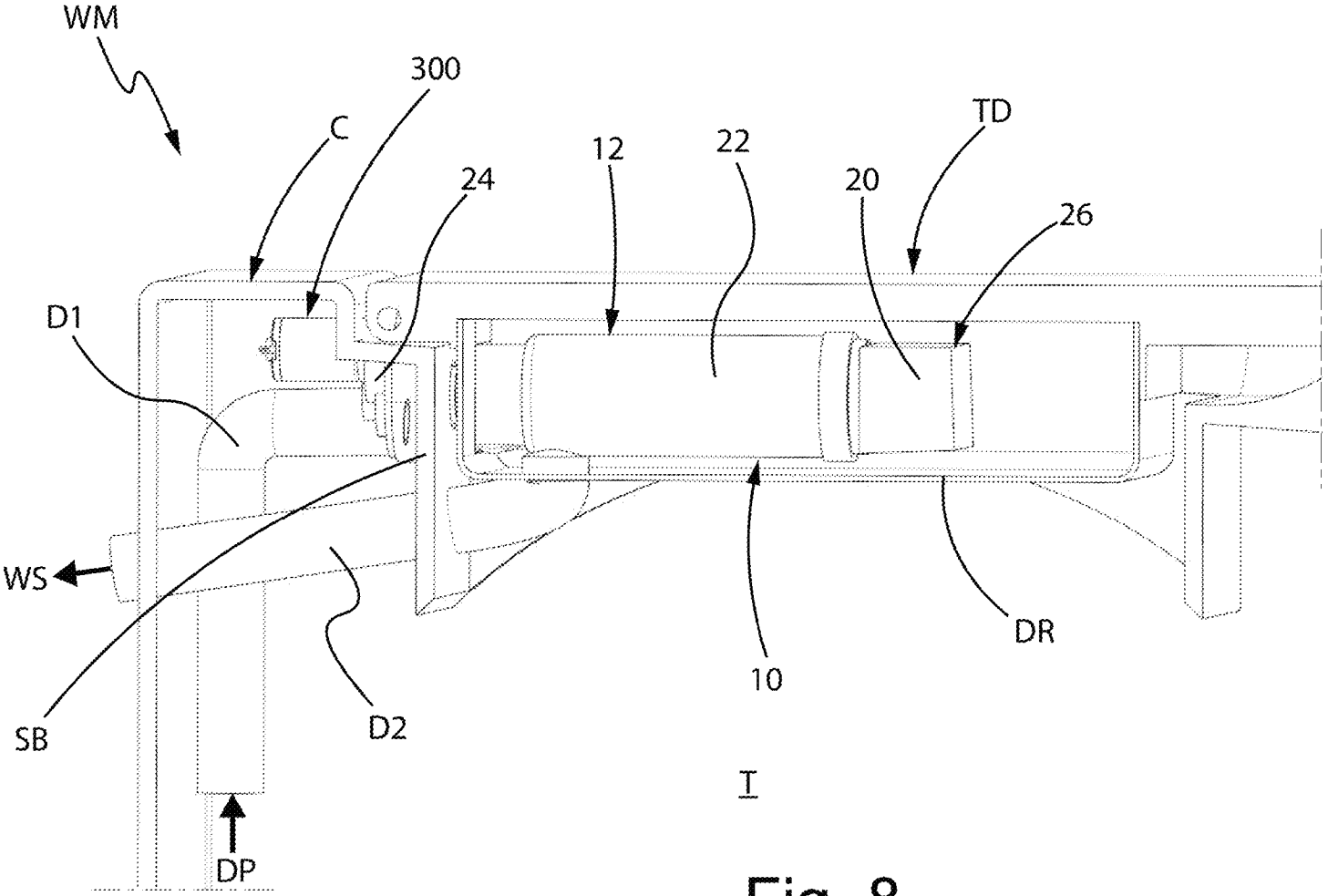
FIGS. 8 and 9 are partial sectional views in side elevation of the washing machine shown in FIGS. 6 and 7, wherein the microplastic filtering system is visible.
Figure 9:
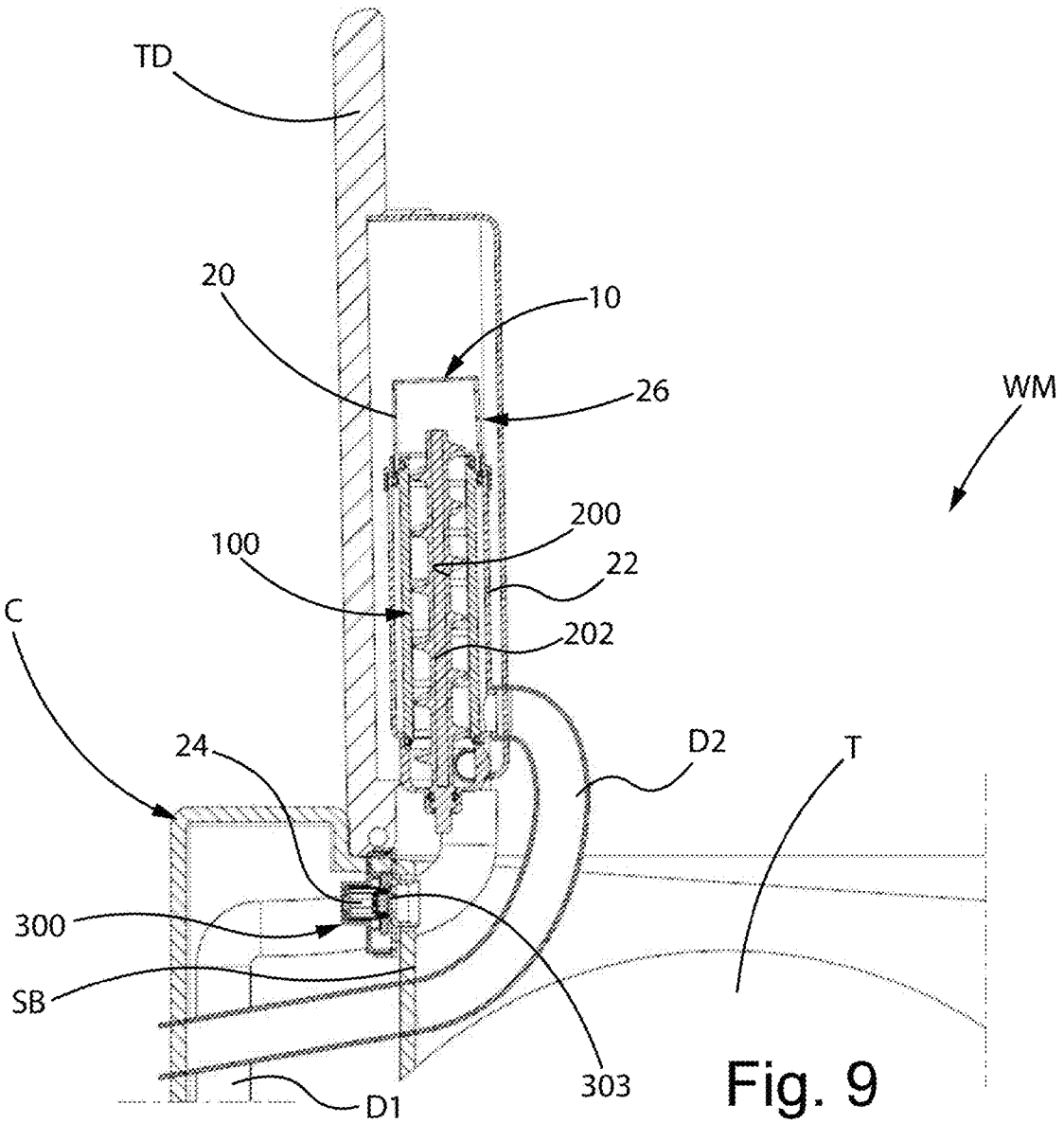

Unlike the previously described embodiment, the stationary support structure whereon cover member 24, which supports driving assembly 300, is mounted is not a drawer holder—which, as mentioned above, is absent—but a support bracket SB mounted to the top of cabinet C. In particular, support bracket protrudes towards washing tub T, e.g. near the opening where top door TD is hinged. In this case, the position of engagement of driven member 303 of driving assembly 300 into endless screw 202 of compacting assembly 200 is obtained when drawer DR is rotated integrally with top door TD into a closed position (FIG. 8), whereas the disengagement position is obtained when drawer DR is rotated integrally with top door TD into an open position (FIGS. 6, 7 and 9).

Support bracket SB supports also initial duct D1, which is connected to inlet 16 of tubular portion 22, and terminal duct D2, which is connected, in turn, to inlet 16 of tubular portion 22.

Of course, without prejudice to the principle of the invention, the forms of embodiment and the implementation details may be extensively varied from those described and illustrated herein by way of non-limiting example, without however departing from the scope of the invention as set out in the appended claims.

The invention claimed is:

1. A washing machine, comprising:

a cabinet in which a washing tub is defined;

a discharge piping fluidically connected to the washing tub on one side, and connectable to a waste system on an other side;

a discharge pump crossed by the discharge piping and configured to push a washing liquid, containing microplastics and coming extending from the washing tub, towards said waste system;

a discharge pump filter crossed by the discharge piping fluidically upstream of said discharge pump, configured to trap any foreign bodies present in the microplastic-containing washing liquid;

a microplastic filtering system crossed by the discharge piping fluidically downstream of said discharge pump; and a drawer;

wherein said system is housed inside said drawer.

2. The machine according to claim 1, wherein said drawer is mounted stationary relative to said cabinet.

3. The machine according to claim 1, wherein said drawer is movably mounted relative to said cabinet.

4. The machine according to claim 1, wherein said drawer defines a receptacle configured to store a quantity of a washing agent.

5. The machine according to claim 4, wherein said drawer is movably mounted relative to said cabinet, and wherein said drawer is extractable from a front wall of said cabinet.

6. The machine according to claim 4, wherein said drawer is movably mounted relative to said cabinet, and wherein said drawer is mounted on an inner face of a top door hinged to said cabinet.

7. The washing machine according to claim 1, wherein said system comprises:

a casing internally defining a cavity and comprising:

an inlet configured to receive a microplastic-containing fluid and leading into the cavity, and an outlet configured to deliver said fluid crossing said cavity, from which said microplastics have been substantially removed;

a filtering assembly contained in the cavity and crossed by the fluid entering said casing through the inlet and exiting through said outlet, thus and internally trapping said microplastics; and a compacting assembly in said cavity and configured for collecting and compacting the microplastics trapped by the filtering assembly.

8. The machine according to claim 7, further comprising a driving assembly configured to drive the compacting assembly.

9. The machine according to claim 8, wherein said drawer is movably mounted relative to said cabinet, and wherein said system is movable as one piece with said drawer relative to said driving assembly between:

an engagement position, in which said driving assembly is enabled to mechanically co-operate with the compacting assembly, and a disengagement position, in which said driving assembly is not enabled to mechanically co-operate with the compacting assembly.

10. The machine according to claim 9, wherein said cabinet comprises a stationary support structure on which said driving assembly is mounted.

11. The machine according to claim 10, wherein said stationary support structure comprises a drawer holder in which said drawer is movably guided.

12. The machine according to claim 10, wherein said stationary support structure comprises a support bracket, and said drawer is mounted to a top door hinged to said cabinet.

13. The machine according to claim 7, further comprising a closure member removably mounted relative to said casing and comprising a storing container configured to store the microplastics collected and compacted by the compacting assembly.

14. The machine according to claim 1, wherein said washing machine comprises a laundry washing machine.

* * * * *